US007661871B2

(12) United States Patent
Hyatt et al.

(10) Patent No.: US 7,661,871 B2
(45) Date of Patent: Feb. 16, 2010

(54) APPARATUS FOR STORING, MIXING, METERING, AND INJECTING POLYMERIC SLURRIES INTO PIPELINES

(76) Inventors: Robert Rinehart Hyatt, 20607 Sunny Shores Dr., Humble, TX (US) 77346; George William Hyatt, 118 Glendale Ct., Elyria, OH (US) 44035

( * ) Notice: Subject to any disclaimer, the term of this patent is extended or adjusted under 35 U.S.C. 154(b) by 336 days.

(21) Appl. No.: 11/340,930

(22) Filed: Jan. 28, 2006

(65) Prior Publication Data

US 2007/0177454 A1 Aug. 2, 2007

Related U.S. Application Data

(60) Provisional application No. 60/649,503, filed on Feb. 3, 2005.

(51) Int. Cl.
*B01F 15/02* (2006.01)

(52) U.S. Cl. ..... 366/136; 366/153.1; 137/563

(58) Field of Classification Search ..... 366/101–104, 366/106–107, 136, 137, 167.1, 173.1, 173.2, 366/153.1, 144, 151.1, 159.1, 160.1, 160.2, 366/162.1; 137/563
See application file for complete search history.

(56) References Cited

U.S. PATENT DOCUMENTS 3,676,075 A * 7/1972 Ploger et al. ..... 422/189
3,830,473 A * 8/1974 Lieferman et al. ..... 366/136
5,439,288 A * 8/1995 Hoffman et al. ..... 366/137
5,522,660 A * 6/1996 O'Dougherty et al. ..... 366/136
5,590,960 A * 1/1997 Clinton et al. ..... 366/134
6,367,960 B2 * 4/2002 Yamazaki et al. ..... 366/149
6,537,450 B2 * 3/2003 Russell et al. ..... 210/194
6,554,467 B2 * 4/2003 Snyder et al. ..... 366/348
6,568,842 B1 * 5/2003 Murray ..... 366/137
6,572,255 B2 * 6/2003 Husher ..... 366/132
7,275,928 B2 * 10/2007 Kolesar et al. ..... 425/447
2005/0232070 A1 * 10/2005 Tung ..... 366/101
2007/0177454 A1 * 8/2007 Hyatt et al. ..... 366/136

FOREIGN PATENT DOCUMENTS

FR 2421669 * 11/1979
JP 58108116 A * 6/1983

* cited by examiner

*Primary Examiner*—Charles E Cooley

(57) ABSTRACT

The present invention generally comprises a storage vessel for the polymeric slurry chemical, a vapor recirculation system, a chemical recirculation system, a device for chemical temperature control, a device for measuring storage vessel level, a device for metering and pumping chemical, and a device for controlling apparatus. The vapor recirculation system, chemical recirculation system, mechanism for chemical temperature control, mechanism for measuring storage vessel level, mechanism for metering and pumping and mechanism for controlling apparatus are housed in the pumping equipment container and are connected to the storage vessel by control conduits, and piping for vapors and liquid chemicals to make the complete apparatus. The apparatus is used to maintain slurry materials in a usable state and to inject the slurry materials as required for specific applications, such as injecting drag reducing agent into operating pipelines.

6 Claims, 4 Drawing Sheets

APPARATUS FOR STORING, MIXING, METERING, AND INJECTING POLYMERIC SLURRIES INTO PIPELINES

CROSS-REFERENCE TO RELATED APPLICATIONS

This application claims the benefit of provisional patent application Ser. No. 60/649,503, filed Feb. 3, 2005 by the present inventors. This U.S. Letters Patent Application is claiming the benefit of the Feb. 3, 2005 filing date under 35 U.S.C. Section 119(e).

FEDERALLY SPONSORED RESEARCH

Not Applicable

SEQUENCE LISTING OR PROGRAM

Not Applicable

BACKGROUND OF THE INVENTION

1. Field of Invention

This invention relates generally to the field of apparatus and methods for storing, mixing, metering, and pumping polymeric slurry chemical. Moreover it pertains specifically to such apparatus for drag reducing agent slurry injection into a pipeline.

2. Prior Art

Many devices have been proposed for storing, mixing, metering, and pumping polymeric slurries. No known patents exist for these devices. However, these devices are limited in their functionality, due in part to inferior construction, poor design, failed reliability, misused component parts, lack of chemistry knowledge concerning the slurry properties, piping code violations, electrical code violations, and OHSA violations. This invention embodies improved methods and apparatus that overcome these deficiencies in a unique and new means.

Most previously offered devices in the area of polymeric slurry storage and pumping have been devised by trial and error with no engineering design or project structure. The chemical has been stored in horizontal containers or square containers with limited or no recirculation methods. This allowed the solids component of the chemical polymeric slurry to settle in the dead zones of the containers and become unpumpable. When any mixing was employed to the chemical slurry with past methods, it introduced ambient air that weathered off the solvent and created concentrated polymer slurries—again unable to be pumped. These devices have been offered by slurry chemical supply companies out of necessity with nominal functionality. Their design and construction evolved through the need to overcome chemical formulation problem characteristics.

The prior injection apparatus includes screw pumps, gear pumps, positive displacement piston pumps, and direct piston driven diaphragm pumps. All these pumps relied heavily on adequate suction where no plugging occurred. However, the storage and mixing methods and apparatus used prior to this invention did not produce a consistent suction stream, and therefore, failed to pump reliably into the pipeline stream. Even more, the extended periods between injection times caused both suction lines and discharge lines to plug due to settled polymer.

These failures were compounded by poor strainer design and misused metering devices, to name a few. The previously used meters were large oval lobe gear meters designed to pump fluids at 60 gallon per minute. Whereas, the injection rates for most applications were required in the range of 1-5 gallons per hour. These oversized meters were inaccurate. Later on, mass meters were used to achieve more accurate measurement. These meters, at the time, were not designed to handle two phase flow—which is the chemical make up of slurried drag reducing agents.

The prior art had little or no provisions built into the control schemes to warn users of impending failures. They employed simple control loops to take measurements from low precision meters and adjust the pump output via pump stroke adjustments to match the desired set point. No methods or means were used to evaluate the chemical consistency and storage characteristics to warn of eventual failures due to inadequate chemical handing strategies. In addition, these control devices did not meet electrical codes, proved too complicated for the end user, and often could not be integrated into the user's computer logic language because of non-standard and unwieldy operation control language.

It is therefore an object of the present invention to provide an improved and more universal method and apparatus for use in storing, mixing, metering, and pumping polymeric slurries which addresses the deficiencies of the prior art.

3. Objects and Advantages

A principal object of the present invention is to provide a storage and pumping unit for polymeric slurries that will overcome the deficiencies of the prior art devices. Several additional objects and advantages of the present invention are:

(a) to provide a vertical storage vessel having a sloped bottom with a mixing system that will sustain a homogeneous mixture of the slurry over time;

(b) to provide a closed loop vapor recirculation system that will prevent any weathering off effects on the chemical;

(c) to provide a mechanical blower device that will recirculate vapor and provide the mixing energy for the storage vessel;

(d) to provide a liquid recirculation system that will charge the injection pumps and prevent suction line plugging;

(e) to provide flow switch devices that monitors and alarm recirculation system failures;

(f) to provide a means for measuring storage vessel level that accurately and remotely measures the liquid level in the storage vessel;

(g) to provide a plurality of vapor return distributor jets in the storage vessel that sufficiently agitates and mixes the chemical in the storage vessel;

(h) to provide a means for chemical temperature control device that adjusts the chemical temperature;

(i) to provide a heat barrier that keeps the mechanical components and chemical cool;

(j) to provide an onboard microprocessor to analyze, monitor, and control operation of component parts of the apparatus for storing, mixing, metering and pumping polymeric slurry chemical;

(k) to provide an apparatus for storing, mixing, metering and pumping polymeric slurry chemical that is more universally functional in today's market than the prior art devices by being able to pump any polymeric slurry chemical produced by any manufacturer where the prior art devices are designed to pump only one manufacturer's of polymeric slurry chemical.

It is intended that any other advantages and objects of the present invention that become apparent or obvious from the detailed description or illustrations contained herein are within the scope of the present invention.

SUMMARY OF THE INVENTION

In view of the limitations now present in the prior art, the present invention provides a new and useful apparatus and method for storing, mixing, metering, and pumping polymeric slurry chemical into a pipeline that carries crude oil, gasoline or diesel fuel; which is simpler in construction, more universally usable and more versatile in operation than known apparatus of this kind.

The purpose of the present invention is to provide a new apparatus and method for storing, mixing, metering, and pumping polymeric slurry chemical that has many novel features not offered by the prior art devices that result in a new apparatus for storing, mixing, metering and pumping polymeric slurry chemical that is not apparent, obvious, or suggested, either directly or indirectly by any of the prior art devices in use today.

The present invention generally comprises a storage vessel for the polymeric slurry chemical, a vapor recirculation system, a chemical recirculation system, a means for chemical temperature control, a means for measuring storage vessel level, a means for metering and pumping chemical, and a means for controlling apparatus. The vapor recirculation system, chemical recirculation system, means for chemical temperature control, means for measuring storage vessel level, means for metering and pumping and means for controlling apparatus are housed in the pumping equipment container and are connected to the storage vessel by control conduits, and piping for vapors and liquid chemicals to make the complete apparatus.

The storage vessel receives the polymeric slurry chemical and stores the chemical to be injected into the pipeline. The storage vessel has connections that allow the storage vessel to interface with the vapor recirculation system, the liquid recirculation system, and the means for measuring storage vessel level. The vapor recirculation system captures the vapors of the slurry chemicals from the top of the storage vessel and recirculates them so they can be distributed back into the slurry chemical in the storage vessel. The chemical recirculation system circulates the slurry chemical to keep the polymer suspended in the slurry chemical to prevent plugging up the piping and storage vessel by circulating the chemical from the bottom of the storage vessel thru the piping and back into the top of the storage vessel. The means for chemical temperature control is used to cool the chemical temperature to prevent additional vapors from evaporating from the slurry chemicals where apparatus is installed in high ambient temperature locations. The means for measuring storage vessel level is used to monitor the level of the slurry chemical inside the storage vessel and to provide the level as a remote output to user. The means for metering and pumping chemical is used to inject a specific quantity of the slurry chemical into an operating pipe line and to maintain a non-resetable total of the amount of slurry chemical injected into the pipeline by the apparatus. The means for controlling apparatus is used to automate the vapor recirculation system, the chemical recirculation system, the means for chemical temperature control, the means for measuring storage vessel level and the means for metering and pumping chemical such that these functions occur at a predetermined time or as required by the user via a remote input to the apparatus.

The combination of storage vessel, the vapor recirculation system, the chemical recirculation system, a means for chemical temperature control, the means for measuring storage vessel level, the means for metering and pumping chemical cooperate by a predetermined method to effectively and consistently store and deliver polymeric slurry chemicals into a pressurized pipeline. The apparatus is constructed of component parts, when assembled according to this invention, provides a method for stable storage of the chemical slurry, accurate metering of the chemical into the pipeline, and fully automated and remote control logic.

The foregoing has outlined, in general, the physical aspects of the invention and is to serve as an aid to better understanding the more complete detailed description, which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

DRAWINGS

Figures

The following drawings further describe by illustration the advantages and objects of the present invention. Each drawing is referenced by corresponding figure reference characters within the "DETAILED DESCRIPTION OF THE INVENTION" section to follow.

DRAWINGS

Reference Numerals

1 PUMPING EQUIPMENT CONTAINER
2 STORAGE VESSEL
3 ELECTRICAL CONTROL ENCLOSURE
4 VAPOR RETURN CHECK VALVE
5 ELECTRICAL CONDUIT TO MEANS FOR MEASURING STORAGE VESSEL LEVEL
6 VESSEL SUCTION LINES
7 VESSEL FILL LINE
8 LEVEL TRANSMITTER
9 LIQUID RECIRCULATION RETURN LINE
10 VAPOR SUCTION LINE
11 VAPOR RETURN LINE
12 LIQUID RECIRCULATION PUMP
13 VAPOR BLOWER
14 COUNTERFLOW HEAT EXCHANGER
15 AIR CHILLER
16 INJECTION PUMP SUCTION LINES
17 PRIMARY INJECTION PUMP
18 SECONDARY INJECTION PUMP
19 FLOW METER
20 OPERATING PIPE LINE
21 INJECTION PUMP DISCHARGE LINE
22 CHILLED AIR EXHAUST
23 CHILLED AIR PIPING
24 INJECTION PUMP MOTORS

25 CONTROL CONDUIT TO RECIRCULATION PUMP MOTOR
26 CONTROL CONDUIT TO BLOWER MOTOR
27 CONTROL CONDUIT TO CHILLER
28 CONTROL CONDUIT TO FLOW METER
29 CONTROL CONDUIT TO INJECTION PUMP MOTORS
30 LIQUID RECIRCULATION PUMP FLOW SWITCH
33 HIGH PRESSURE SHUTDOWN SWITCH
32 ELECTRIC MOTOR FOR RECIRCULATION PUMP
33 BACK PRESSURE CONTROL VALVE
34 CONTROL CONDUIT FROM LIQUID RECIRCULATION FLOW SWITCH
35 CONTROL CONDUIT FROM HIGH PRESSURE SHUTDOWN SWITCH
36 VAPOR RETURN DISTRIBUTOR JET
37 VAPOR RETURN FLOW SWITCH
38 CONTROL CONDUIT FROM VAPOR FLOW SWITCH
39 AMBIENT AIR RETURN
40 DISCHARGE LINE BACK PRESSURE CHECK VALVE
41 VAPOR BLOWER MOTOR
42 VAPOR DISTRIBUTOR PIPING
49 MICROPROCESSOR BASED LOGIC CONTROLLER

DETAILED DESCRIPTION

FIGS. 1, 2, 3, 4—Preferred Embodiment

Figure 1:
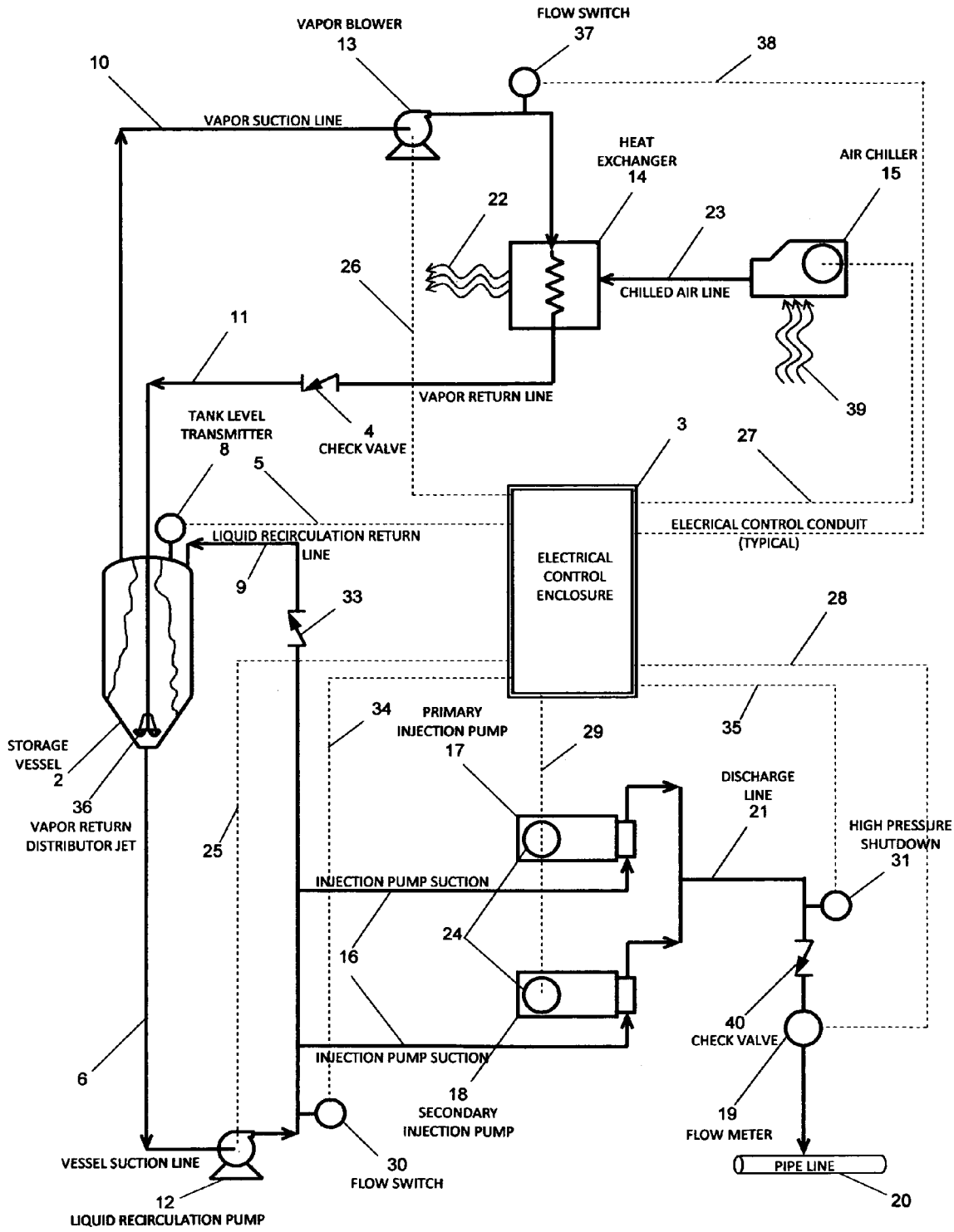
FIG. 1 is a flow diagram of the entire injection system according to the present invention.

Referring to the figures of the drawings, wherein like numerals of reference designate like elements throughout the several views, particularly to FIG. 1, there is shown a flow diagram of an apparatus for storing, mixing, metering and pumping polymeric slurry chemicals. The apparatus comprises a storage vessel for the polymeric slurry chemical (2), a vapor recirculation system (10), (13), (37) (4) (11) (36), a chemical recirculation system (6), (12), (30), (33), (9), a means for chemical temperature control (39), (15), (23), (14), (22), a means for measuring storage vessel level (8), a means for metering and pumping chemical (6), (16), (17), (18), (24), (21), (31), (40), (19), (20), a means for mixing (42), (36), and a means for controlling apparatus (3), (25), (26), (27), (28), (29), (34), (35), (38), (49). The majority of the components that make up the chemical recirculation system, the means for chemical temperature control, the means for metering and pumping chemical, and the means for controlling apparatus are housed in the pumping equipment container (1) and are interconnected to the storage vessel (2) via a plurality of lines (6) (7) (9) (10) & (11) and are interconnected to the means for measuring storage vessel level (8) via at least one control conduit (5).

Figure 4:
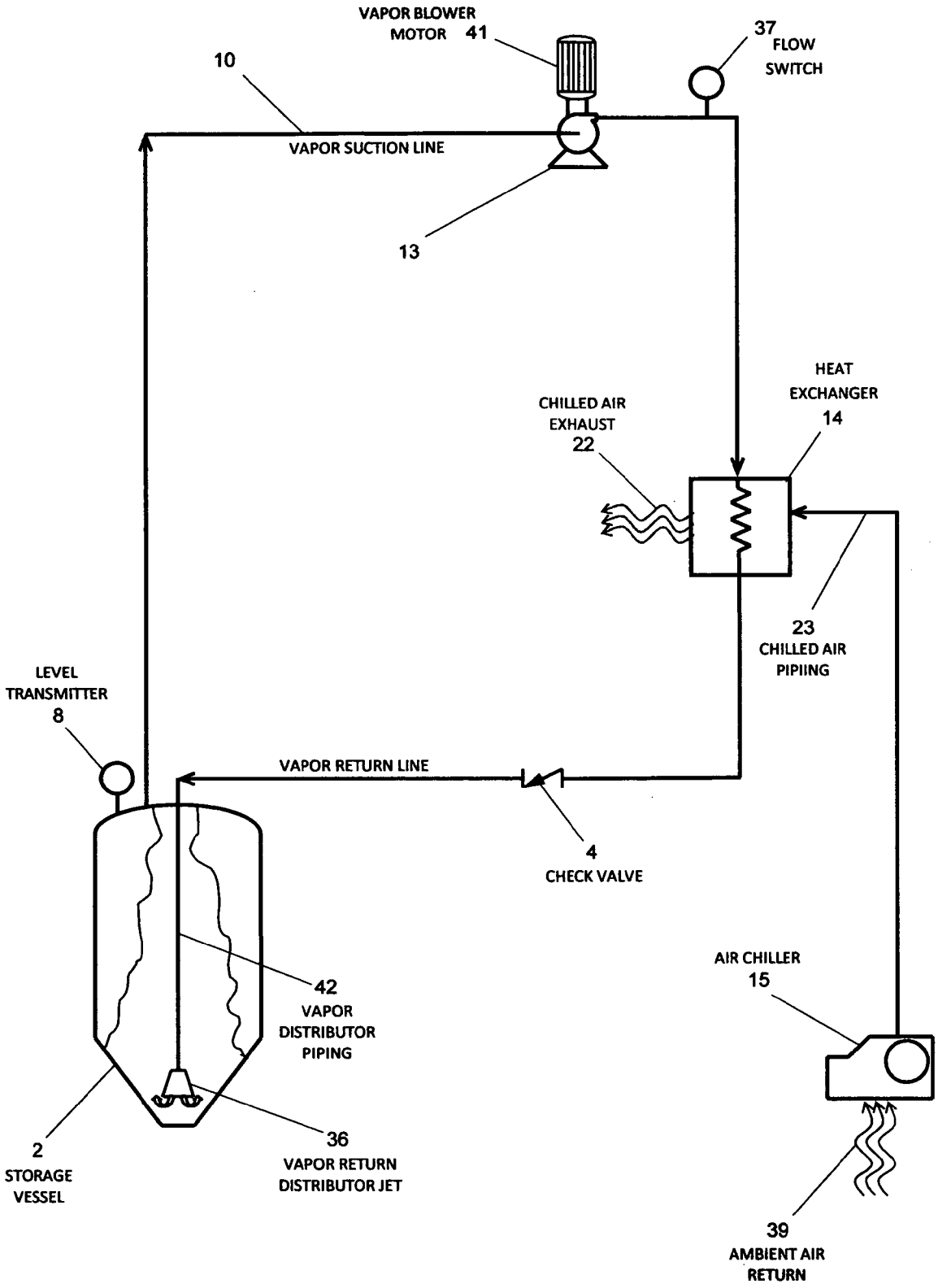
FIG. 4 is a block diagram of the vapor recirculation components according to the present invention.

As shown in FIGS. 1 & 4, the storage vessel (2) is a vertical vessel with a sloped bottom. The preferred mode the storage vessel (2) is a cylindrical shaped vessel having a cone shaped bottom where the slope of the cone being at least a 29 degree that tapers down to the where the chemical recirculation system is attached to the storage vessel (2) by the vessel suction line (6). The storage vessel (2) has a vessel fill line (7) that is use to fill the storage vessel (2) with slurry chemical material. The preferred mode the storage vessel (2) is to be fabricated from either carbon steel or polyethylene, but can be of any material. Another configuration of the storage vessel (2) could be a square vertical vessel with a sloping bottom. The storage vessel (2) has at lease a 2" opening to receive a vessel suction line (6) of the chemical recirculation system that is used to provide liquid chemical feed to the liquid recirculation pump (12).

Figure 2:
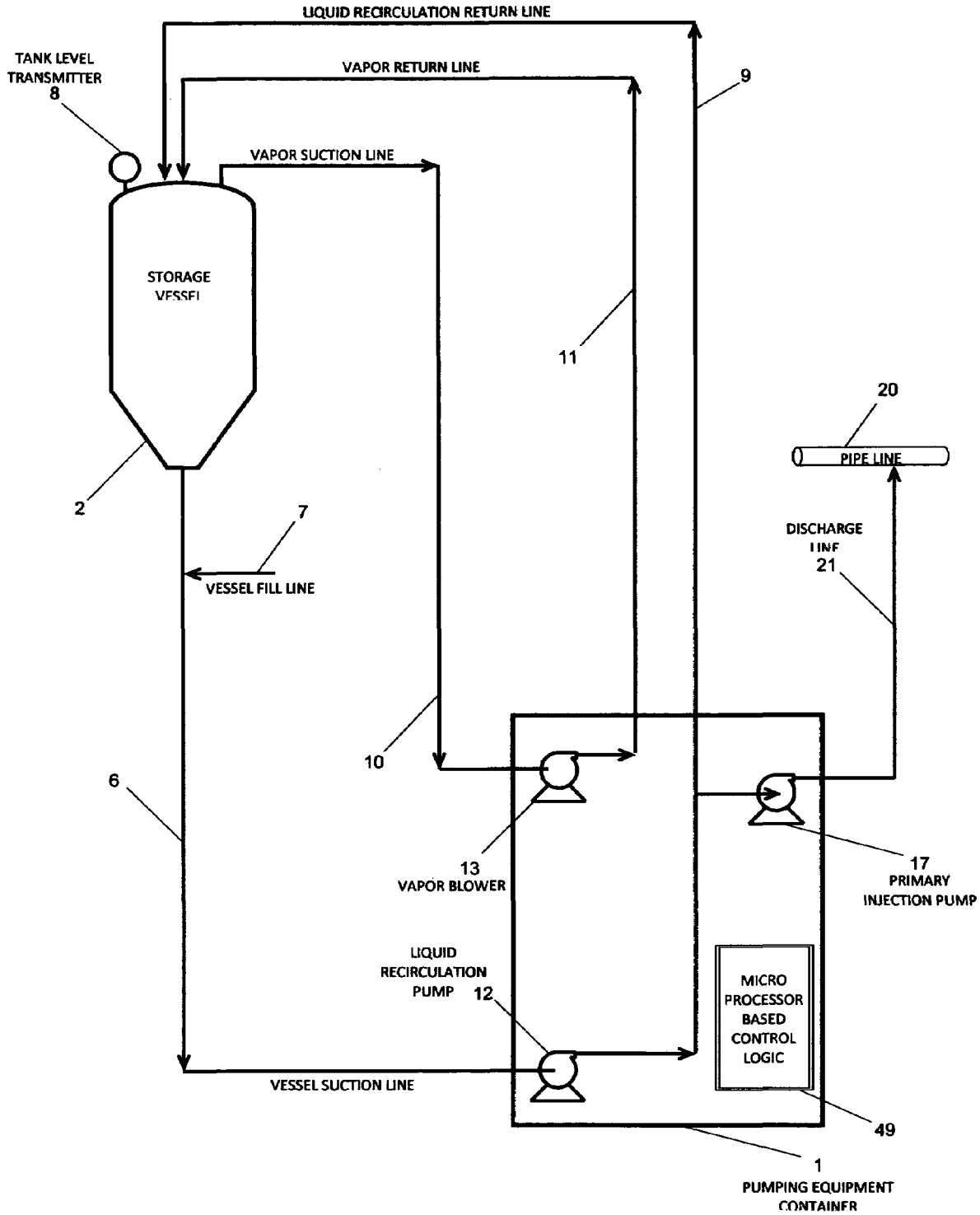
FIG. 2 is a simple block diagram of the storage and injection system, specifically the equipment in pump equipment container according to the present invention.

As seen from FIGS. 1, 2, and 4, the vapor recirculation system comprises a vapor suction line (10), a vapor blower (13) that is driven by a vapor blower motor (41), a vapor return flow switch (37), a counterflow heat exchanger (14), a vapor return check valve (4), and a vapor return line (11). The vapor suction line (10) is connected to the top of the storage vessel (2) where vapor from the storage vessel (2) is withdrawn via a vapor blower (13). The vapor, under the preferred embodiment, is charged through the counterflow heat exchanger (14) and returned to the storage vessel (2) through the vapor return check valve (4) and the vapor return line (11) into the means for mixing, which is received inside the storage vessel (2) in a predetermined location.

Again, referring to FIGS. 1 and 4, the means for mixing comprises the combination of a vapor distributor piping (42) and a vapor return distributor jet (36). The vapor distributor piping (42) and the vapor return distributor jet (26) are received inside the storage vessel (2), where one end of the vapor distributor piping (42) is located at the top of the storage vessel (2) and is connected to the vapor return line (11) of the vapor recirculation system and the opposite end of the vapor distributor piping (42) is connected to the vapor return distributor jet (36) near the bottom of the storage vessel (2). The vapor return distributor jet (36) having a predetermined shape and in the preferred embodiment is substantially cone shaped with the vapor distributor piping (42) connected to the vapor return distributor jet (36) at the pointed end of the cone shape such that the vapor recirculation system (43) forces the vapor though the vapor distributor piping (42) and the vapor return distributor jet (36) to expel the vapor over the cone-shaped vapor return distribution jet (0.36) thus distributing the charged vapor radically along the sides and near the bottom of the vessel into the slurry chemical materials to allow the vapor to be absorbed back into the slurry chemical materials.

Figure 3:
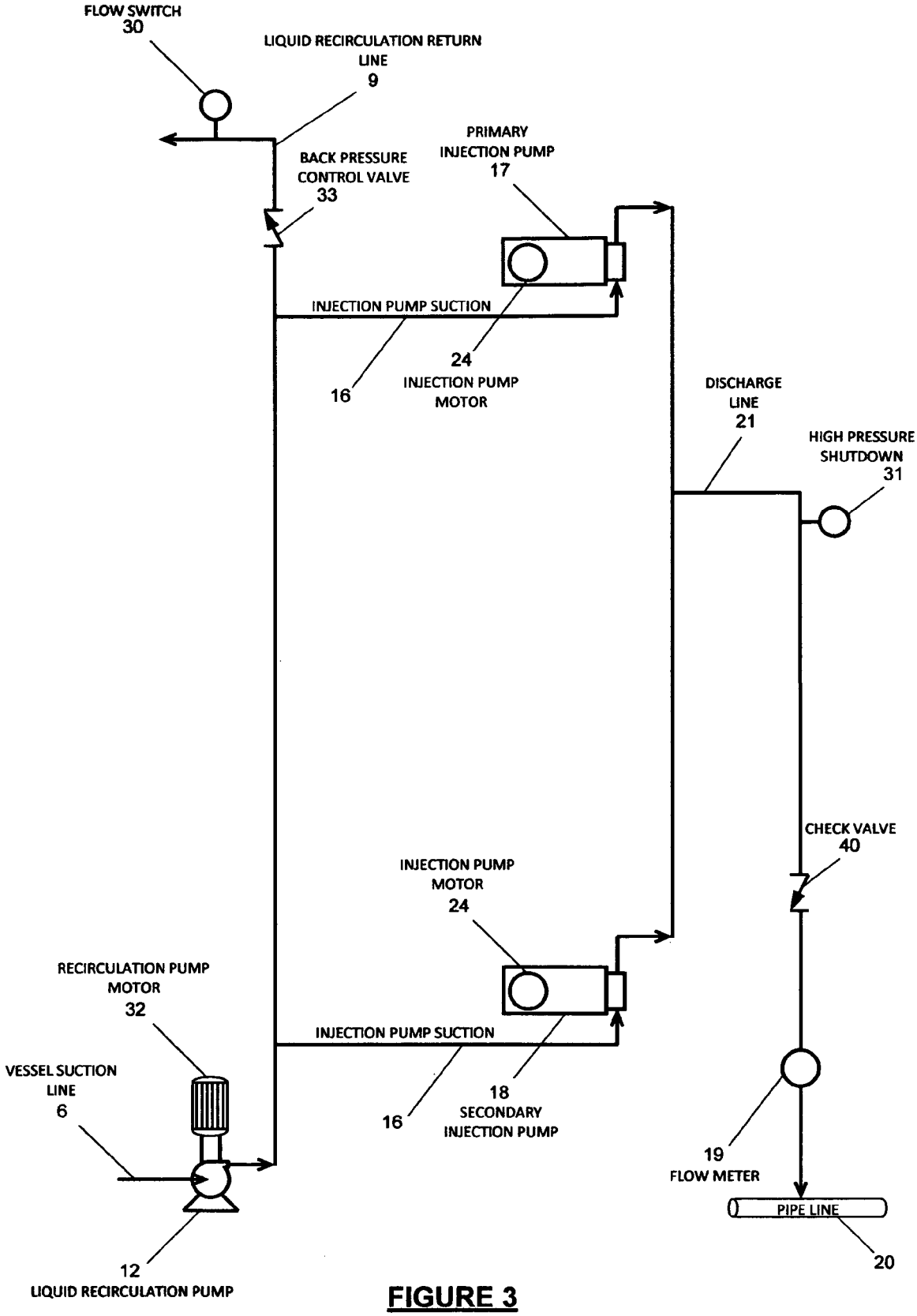
FIG. 3 is a block diagram of liquid delivery components according to the present invention.

Now referring to FIGS. 1, 2, & 3, the chemical recirculation system comprises a vessel suction line (6), a liquid recirculation pump (12), injection pump suction lines (16), a back pressure control valve (33), a liquid recirculation pump flow switch (30) and a liquid recirculation return line (9). The chemical recirculation system circulates the chemical slurry material through the storage vessel (2) and other components to keep the slurry material from clogging up the apparatus. The chemical slurry liquid flows out of the storage vessel (2), via the vessel suction line (6), into the liquid recirculation pump (12); where the present embodiment of the liquid recirculation pump (12) is a gear pump, but can also could be a diaphragm or progressive cavity pump. The liquid is then discharged from the recirculation pump (12) and travels to a primary injection pump (17) and then a secondary injection pump (18) via the injection pump suction lines (16) to provide a liquid feed to the primary injection pump (17) and the secondary injection pump (18), then returns the liquid via a liquid recirculation return line (9) to the top of the storage vessel (2). The flow is monitored by the liquid recirculation pump flow switch (30) and back flow is prevented by the back pressure control valve (33).

Under the present invention shown in FIGS. 1 and 3, a means for metering and pumping chemicals comprises a primary injection pump (17), a secondary injection pump (18), an injection pump discharge line (21), a discharge line back pressure check valve (40), a means for measuring flow (19) and a high pressure shutdown switch (31). In cooperation with the recirculation system, the primary injection pump (17) and the secondary injection pump (18) take liquid suction from the liquid circulation return line (9) and injection pump suction lines (16) and increase the pressure to allow for chemical injection via the injection pump discharge line (21) into the operating pipeline (20). Under the present invention, the mode for the injection pumps (17) & (18) is a positive displacement diaphragm pump. Another embodiment could be packed piston positive displacement pumps or progressive cavity pumps where high pressure discharge can be attained. The injection flow is monitored by the means for measuring the flow comprising further of flow meter (19). The preferred mode the flow meter (19) is a mass meter, but could also include a gear meter, or magnetic meter. The discharge line back pressure check valve (40) prevents any back flow of high pressure liquids from the pipeline (20), and a high pressure shutdown switch (31) protects the piping from any over pressure condition by disabling the system when maximum allowable pressure is exceeded.

Referring to FIGS. 1 & 2, the means for measuring storage vessel level in the storage vessel (2) comprises a level transmitter (8) mounted on the storage vessel (2) that electronically monitors the liquid level in the vessel. The preferred embodiment of the level transmitter (8) is a low frequency radar wave instrument, but could be an ultrasonic level instrument or a float based instrument. This signal is transmitted to a microprocessor based logic controller (49) for further data collection and transmission.

As shown in FIGS. 1 & 4, the means for chemical temperature control comprises an air chiller (15) having a ambient air return (39), a chilled air piping, a counterflow heat exchanger (14) having a chilled air exhaust (22). The air chiller (15) in the preferred embodiment is a standard compressed refrigerant unit is used to pass chilled air through a chilled air piping (23) across a counterflow heat exchanger (14) and out the chilled air exhaust (22). The process side of the counterflow exchanger (14) has higher temperature vapor that is pumped from the vapor blower (13). The heat from the vapor is exchanged with the chilled air from the air chiller (15) in the counterflow heat exchanger (14) thus producing both cooled vapor and heated air. The chilled vapor is transported through the vapor return line (11) and expelled at the bottom of the storage vessel (2) through the vapor distributor piping (42) and the vapor return distributor jet (36) where the cool vapor bubbles through the stored liquid to lower the liquid temperature. The heated air is discharged from the chilled air exhaust (22) outlet of the counterflow heat exchanger (14).

Referring to FIGS. 1 and 2, the means for controlling apparatus comprises a microprocessor based logic controller (49), that is housed in an electrical control enclosure (3), and a plurality of control circuits in conduits (25), (26), (27), (28), (29), (34), (35) & (38). The microprocessor based logic controller (49) collects information from the apparatus instruments and external customer sources to perform processes to start and stop machinery such as an electric motor for recirculation pump (32) and a vapor blower motor (41); fluctuate motor frequencies of the injection pump motors (24) to vary injection pumping flow rates; alarm malfunctions such as the liquid recirculation pump flow switch (30) and the vapor return flow switch (37); emergency shut down equipment such as the high pressure shutdown switch (31), and transmit operating data such as the means for measuring storage vessel level (8) and means for measuring flow (19).

Whereas, the present invention has been described in relation to the drawings attached hereto, it should be understood that other and further modifications, apart from those shown or suggested herein, may be made within the spirit and scope of this invention.

What is claimed is:

1. An apparatus to store, mix, meter and pump a slurry chemical material comprising:

a storage vessel, the storage vessel being substantially a vertical vessel having a predetermined shape for receiving and storing the slurry chemical material;

a vapor recirculation system, the vapor recirculation system cooperates with the storage vessel to collect vapors that evaporate from the slurry chemical materials and injects the vapors into a means for mixing, where the means for mixing being received inside the storage vessel such that the storage vessel, the recirculation system and the means for mixing cooperate to cause the vapors to be absorbed back into the slurry chemical materials;

a liquid recirculation system;

a means for metering and pumping chemical material; the liquid recirculation system cooperates with the storage vessel and the means for metering and pumping chemical material to circulate slurry chemical materials from the bottom of the storage vessel to the top of the storage vessel and to the inlet of the means for metering and pumping chemical at a predetermined flow rate and predetermined pressure such that the slurry chemical materials are maintained in a semi-liquid state and such that the slurry chemical materials can be received into the means for metering and pumping chemical material to allow a measured amount of slurry chemical material to be pumped by the apparatus; and a means for controlling apparatus, the means for controlling apparatus cooperates with the vapor recirculation system, the liquid recirculation system and the means for metering and pumping chemical material to provide predetermined logic that directs and monitors the vapor recirculation system, the liquid recirculation system and the means for metering and pumping chemical material such that combination provides for the storing, mixing, metering and pumping of the slurry chemical material.

2. An apparatus as recited in claim 1 further comprising a means for measuring storage vessel level, the means for measuring storage vessel level being received in the storage vessel to determine the level of the slurry chemical material inside the storage vessel and provide output of the slurry chemical material level.

3. An apparatus as recited in claim 1 further comprising a means for chemical temperature control, the means for chemical temperature control used to maintain the slurry chemical material to a predetermined temperature in the storage vessel to minimize the effect of the ambient temperature on the slurry chemical materials.

4. An apparatus as recited in claim 1, the means for mixing further comprises a vapor distributor piping and a vapor return distributor jet, the vapor distributor piping and the vapor return distributor jet are received inside the storage vessel, where one end of the vapor distributor piping is located at the top of the storage vessel and is connected to the vapor recirculation system and the opposite end of the vapor distributor piping is connected to the vapor return distributor jet near the bottom of the storage vessel, the vapor return distributor jet having a predetermined shape and is substantially cone shaped with the vapor distributor piping connected to the vapor return distributor jet at the pointed end of the cone shape such that the vapor recirculation system forces the vapor though the vapor distributor piping and the vapor return distributor jet to inject the vapor into the slurry chemical materials to allow the vapor to be absorbed back into the slurry chemical materials.

5. An apparatus as recited in claim 1, the storage vessel having a sloped bottom with a predetermined area that is smaller than the remainder of the storage vessel to direct the slurry chemical material to the inlet of the liquid recirculation system.

6. An apparatus as recited in claim 5, the storage vessel slope bottom having at least a 29-degree slope from the vertical side of upper part of the storage vessel.

* * * * *